US007547097B2

(12) United States Patent
Tsukada et al.

(10) Patent No.: US 7,547,097 B2
(45) Date of Patent: Jun. 16, 2009

(54) LIQUID EJECTION APPARATUS AND LIQUID FILLING METHOD OF LIQUID EJECTION APPARATUS

(75) Inventors: Kenji Tsukada, Nagano-ken (JP); Takeo Seino, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 326 days.

(21) Appl. No.: 11/249,463

(22) Filed: Oct. 14, 2005

(65) Prior Publication Data

US 2006/0082621 A1 Apr. 20, 2006

(30) Foreign Application Priority Data

Oct. 15, 2004 (JP) ..... 2004-301055
Sep. 20, 2005 (JP) ..... 2005-272411

(51) Int. Cl.
*B41J 2/175* (2006.01)
*B41J 2/19* (2006.01)

(52) U.S. Cl. ..... 347/85; 347/92

(58) Field of Classification Search ..... 347/29–30, 347/84, 85, 92, 94; 141/2, 18
See application file for complete search history.

(56) References Cited

U.S. PATENT DOCUMENTS 4,149,172 A * 4/1979 Heinzl et al. ..... 347/92
4,636,814 A * 1/1987 Terasawa ..... 347/86
5,252,993 A * 10/1993 Tomii et al. ..... 347/32
5,992,990 A * 11/1999 Childers et al. ..... 347/87
6,059,405 A * 5/2000 Mochizuki et al. ..... 347/92
6,267,474 B1 * 7/2001 Mochizuki ..... 347/86
6,485,137 B2 * 11/2002 Karlinski et al. ..... 347/92
6,733,114 B2 * 5/2004 Kobayashi et al. ..... 347/85
7,004,557 B2 * 2/2006 Inoue ..... 347/19
7,014,303 B2 * 3/2006 Matsushita et al. ..... 347/85

FOREIGN PATENT DOCUMENTS

JP 55-071568 5/1980
JP 62-090253 4/1987
JP 62-279955 12/1987
JP 2003-211688 7/2003
JP 2003-211689 A 7/2003

* cited by examiner

*Primary Examiner*—Anh T. N. Vo
(74) *Attorney, Agent, or Firm*—Sughrue Mion, PLLC

(57) ABSTRACT

In a first preliminary filling step, ink edge is moved to a position between first and second pressure chambers in an ink supply passage and the second pressure chamber is filled preliminarily with the ink. In a second preliminary filling step, the ink edge is moved to a position between the first pressure chamber and a nozzle in the ink supply passage. Meanwhile, bubbles are discharged from the second pressure chamber and the first pressure chamber is preliminarily filled with the ink. Finally, in the complete filling step, the supply passage is filled entirely with the ink.

8 Claims, 7 Drawing Sheets

LIQUID EJECTION APPARATUS AND LIQUID FILLING METHOD OF LIQUID EJECTION APPARATUS

CROSS-REFERENCES TO RELATED APPLICATIONS

This application is related to and claims priority from Japanese Patent Application Nos. 2004-301055 and 2005-272411, the contents of which are incorporated herein by reference.

BACKGROUND OF THE INVENTION

The present invention relates to liquid ejection apparatuses ejecting liquid from liquid ejection heads as liquid droplets, such as inkjet recording apparatuses, display manufacturing apparatuses, electrode manufacturing apparatuses, and biochip manufacturing apparatuses, as well as liquid filling methods of the liquid ejection apparatuses.

Conventionally, inkjet printers are known as the liquid ejection apparatuses, which eject liquid from nozzles of an ejection head as liquid droplets. Some of the inkjet printers employ off-carriage type ink supply systems. More specifically, in these systems, liquid containers are installed outside carriages.

For example, Japanese Laid-Open Patent Publication No. 2003-211689 describes a printer that has a large-capacity ink cartridge located as spaced from an ejection head and supplies ink from the ink cartridge to the ejection head through a supply tube. The printer further includes a sub tank formed by a flexible container that is arranged between the ink cartridge and the ejection head. An open-close valve is deployed between the ink cartridge and the sub tank for selectively opening and closing the supply tube.

The publication also describes an initial ink filling method of the printer. The method is performed before initial use of the printer for filling a passage including the supply tube and the sub tank (hereinafter, referred to as a "supply passage") with the ink from the ink cartridge. This is typically performed by sealing a nozzle surface of the ejection head using a cap and depressurizing the interior of the cap, thus drawing ink from communication lines through the nozzles.

At this stage, it is necessary to draw the ink from the supply passage without generating bubbles in the passage. However, if the printer is an off-carriage type including an extremely long passage as in the case of Japanese Laid-Open Patent Publication No. 2003-211689, the speed at which the ink flows through the supply passage cannot be increased sufficiently for suppressing bubble generation, due to anti-movement resistance of the ink, or head loss. Particularly, if the supply passage includes an enlarged portion such as the sub tank, an air layer is easily formed in this portion. This is a major factor that hampers the ink fill.

So as to solve this problem, the initial ink filling method of the aforementioned document involves choke suction. That is, suction is performed with the open-close valve held in a closed state, or in a choked state. This causes relatively great negative pressure in a portion downstream from the open-close valve. The negative pressure acts to remove the air from the sub tank. If the open-close valve is opened in this state, the ink is efficiently supplied to the supply passage.

Nonetheless, even by the choke suction, the ink cannot be supplied entirely to the supply passage without generating the bubbles by a single cycle of operation. Therefore, multiple cycles of ink suction must be performed after the choke suction. In this manner, or by filling the supply passage with the ink through the multiple cycles of ink suction, pulsation is generated in the ink flow in such a manner as to efficiently discharge the bubbles.

However, in this case, a relatively large amount of ink is wasted, particularly if the printer has the off-carriage type ink supply system. This is disadvantageous economically and environmentally.

SUMMARY OF THE INVENTION

Accordingly, it is an objective of the present invention to provide a liquid ejection apparatus in which liquid filling is efficiently performed and an efficient liquid filling method of the liquid ejection apparatus.

To achieve the foregoing and other objectives and in accordance with the purpose of the present invention, the invention provides a liquid filling method for filling a continuous supply passage with a liquid supplied from a liquid container of a liquid ejection apparatus. The apparatus includes the supply passage for supplying the liquid from the liquid container that retains the liquid to a nozzle for ejecting the liquid. The method includes a preliminary filling step for moving the edge of the liquid to a preliminary position in the supply passage. The method further includes a complete filling step for filling the supply passage entirely with the liquid subsequent to the preliminary filling step.

The continuous supply passage includes a supply tube that connects the liquid container to an ejection head, a joint portion between the ejection head and the supply tube, and communication passages defined in each of the nozzles in correspondence with the colors of the liquid.

The edge of the liquid is defined as the leading edge of the liquid supplied from the liquid container. If the supply passage is originally filled with preservative liquid (that has been originally introduced into the supply passage), the liquid edge corresponds to the position of the interface between the liquid and the preservative liquid. If the supply passage is originally empty (or filled with a gas), the liquid edge corresponds to the position of meniscus of the liquid formed in the supply passage.

According to the method of the present invention, pulsation is generated in the liquid flow in the supply passage by performing the preliminary filling step and the complete filling step. Thus, when the supply passage is filled entirely with the liquid in the complete filling step, bubbles are effectively discharged from the supply passage. Accordingly, the supply passage is filled with the liquid efficiently.

It is preferred that the preliminary position in the supply passage correspond to a position between a bubble trapping portion of the supply passage in which bubbles are trapped when the supply passage is filled with the liquid and the nozzle.

The bubble trapping portion is defined as a portion of the supply passage from which the bubbles are (an air layer is) difficult to remove. It is thus extremely difficult to fill the bubble trapping portion with the liquid through a single cycle of, for example, suction. If the amount (the discharge amount) of the liquid flow caused by the suction is increased, the amount of the liquid passing through the bubble trapping portion is increased. However, the liquid flow in the vicinity of the bubbles becomes constant after a certain period of time, making it difficult to discharge the bubbles from the bubble trapping portion. In order to solve this problem, in the prior art, after the supply passage is filled entirely with the liquid, multiple cycles of suction are performed for generating pulsation in the liquid flow, thus discharging the remaining bubbles. In this case, the liquid flow in the supply passage acts to discharge the bubbles from the bubble trapping portion through the nozzle. However, the liquid located closer to the nozzle than the bubbles (downstream from the bubbles) is discharged with the bubbles. In other words, although only the liquid flow in the vicinity of the bubbles is necessary for discharging the bubbles, the liquid downstream from the bubbles must be discarded as waste.

According to the method of the present invention, the bubbles are discharged from the bubble trapping portion through pulsation of the liquid flow, like the prior art. However, in the preliminary filling step, the bubble trapping portion is preliminarily filled with the liquid while maximally suppressing change of the liquid edge to a further downstream position. That is, unlike the prior art in which the bubbles are discharged from the bubble trapping portion after the liquid edge reaches the nozzle, the bubble discharge from the bubble trapping portion is started in the complete filling step with the liquid edge maintained at the preliminary position. Accordingly, by filling the supply passage entirely with the liquid in the complete filling step, the bubbles are effectively discharged from the bubble trapping portion and the amount of the liquid downstream from the bubbles decreases. This reduces the amount of the discarded liquid compared to the prior art, and the supply passage is efficiently filled with the liquid.

It is also preferred that the supply passage include a tubular line and an enlarged portion communicating with the tubular line and having a width larger than the width of the tubular line, and that the bubble trapping portion be formed by the enlarged portion.

The enlarged portion is defined as an enlarged passage portion communicating with the tubular line and having a width larger than the tubular line. The enlarged portion corresponds to, for example, a sub tank provided in the supply tube. The configuration of the enlarged portion makes it difficult to discharge the bubbles (remove the air layer) from the enlarged portion in the supply passage. In this regard, the enlarged portion is a type of bubble trapping portion.

According to the method of the present invention, the bubbles are discharged from the enlarged portion through pulsation of the liquid flow, like the prior art. However, in the preliminary filling step, the enlarged portion is preliminarily filled with the liquid while maximally suppressing change of the liquid edge to a further downstream position. That is, unlike the prior art in which the bubbles are discharged from the enlarged portion after the liquid edge reaches the nozzle, the bubble discharge from the enlarged portion is started in the complete filling step with the liquid edge maintained at the preliminary position. Accordingly, by filling the supply passage entirely with the liquid in the complete filling step, the bubbles are effectively discharged from the enlarged portion and the amount of the liquid downstream from the bubbles decreases. This reduces the amount of the discarded liquid compared to the prior art, and the supply passage is efficiently filled with the liquid.

It is further preferred that the supply passage be filled not with the liquid but with a gas before the preliminary filling step is performed.

If, for example, the supply passage of the liquid ejection apparatus does not retain the preservative liquid, the supply passage is held in an empty state (does not include the liquid) until the preliminary filling step is performed. When, for example, suction is performed and the liquid is introduced into the supply passage, the liquid forms meniscus in the supply passage and the meniscus moves toward the nozzle. Movement (flow) of the liquid generates relatively large anti-movement resistance (head loss). In contrast, movement of the air produces relatively small anti-movement resistance, since the air has extremely low viscosity. Thus, if the supply passage is originally empty, the anti-movement resistance produced by the movement of the liquid becomes greater as the meniscus moves closer to a downstream end. That is, in the initial liquid fill, as the position of the meniscus becomes closer to the downstream end, the flow rate of the liquid, or bubble discharge performance, becomes lower. That is, as is clear from this fact, the bubbles are effectively discharged from the supply passage in the complete filling step with the meniscus maintained at the preliminary position in the supply passage, compared to the prior art in which such bubble discharge is performed with the supply passage entirely filled with the liquid.

According to the method of the present invention, the bubbles are discharged from the enlarged portion through pulsation of the liquid flow, like the prior art. However, in the preliminary filling step, the enlarged portion is preliminarily filled with the liquid while maximally suppressing change of the liquid edge to a further downstream position. That is, unlike the prior art in which the bubbles are discharged from the enlarged portion after the liquid edge reaches the nozzle, the bubble discharge from the enlarged portion is started in the complete filling step with the liquid edge maintained at the preliminary position. Accordingly, in the complete filling step, the bubbles are effectively discharged from the enlarged portion by the liquid flow proceeding at a relatively high speed compared to the prior art. The supply passage is thus efficiently filled with the liquid.

It is also preferred that, in the liquid ejection apparatus including suction means for drawing a gas and the liquid from the supply passage through the nozzle, the preliminary and complete filling steps of the method each include a choke suction step in which suction is performed by the suction means with a portion of the supply passage held in a closed state, as well as a great negative pressure suction step in which the liquid is caused to flow by opening the closed portion of the supply passage.

The suction means is formed by, for example, a cap for sealing a nozzle surface of the ejection head and a suction pump for depressurizing the interior of the cap. By sealing the nozzle surface of the ejection head by means of the cap and depressurizing the interior of the cap, the suction means draws the liquid and the air from the supply passage through the nozzle (suction).

In this case, the choke suction step is executed for increasing the negative pressure in the supply passage. Subsequently, the great negative pressure suction step is performed for producing a rapid liquid flow, thus discharging the bubbles (removing the air layer) from the enlarged portion efficiently.

If the air layer (an air phase area) is maintained in a downstream portion of the supply passage after the preliminary filling stop, the bubbles are discharged from the enlarged portion further effectively by performing the choke and great negative pressure suction steps. That is, if an area in which negative pressure is accumulated includes the air layer, compliance (a physical amount representing volume change in correspondence with a pressure difference) becomes relatively great in the area and thus increases the speed of the resulting liquid flow, compared to a case in which the area does not include the air layer.

The conventional method (Japanese Laid-Open Publication No. 2003-211689) includes a procedure similar to the choke suction step and the great negative pressure suction step. However, in this case, the negative pressure accumulated in the first, choke suction step is canceled before the liquid reaches the enlarged portion. This indicates that the enlarged portion must be filled with the liquid through normal suction. Further, if the choke suction step is performed for discharging the bubbles from the enlarged portion with the supply passage filled entirely with the liquid, the speed of the resulting liquid flow is relatively low compared to the present invention, since the compliance in the negative pressure accumulating area is relatively small. Contrastingly, in the present invention, the complete filling step is performed with the liquid edge maintained at the preliminary position. Therefore, the compliance in the negative pressure accumulating area becomes relatively great, thus improving the bubble discharge performance. That is, compared to the prior art, the method of present invention provide specific advantages.

It is also preferred that, in the method in which the suction means of the liquid ejection apparatus includes a suction pump, that the suction pump be continuously operated in a state transitional from the choke suction step to the great negative pressure suction step.

If the suction pump is stopped in the state transitional from the choke suction step to the great negative pressure suction step, the negative pressure diminishes (the absolute value of the pressure becomes increases), thus lowering the bubble discharge performance. The method of the present invention solves this problem.

It is further preferred that, in the choke suction step, the position of the closed portion of the supply passage be closer to the liquid container than the enlarged portion.

In this case, the negative pressure in the enlarged portion is increased by performing the choke suction step. The bubbles are discharged (the air layer is removed) efficiently from the enlarged portion when the supply passage is filled with the liquid.

It is also preferred that, in the method in which the supply passage includes a first enlarged portion and a second enlarged portion that is located closer to the nozzle than the first enlarged portion in the supply passage, the method include a first preliminary filling step in which the preliminary filling step is performed with the preliminary position defined as a position between the first enlarged portion and the second enlarged portion in the supply passage, a second preliminary filling step in which the preliminary filling step is performed with the preliminary position defined as a position between the second enlarged portion and the nozzle in the supply passage, and the complete filling step.

This method is applied to a liquid ejection apparatus in which a supply passage includes multiple enlarged portions.

In this case, the bubbles discharged from the upstream enlarged portion (the first enlarged portion) may be re-trapped in the downstream enlarged portion (the second enlarged portion). Thus, if the liquid filling of the upstream enlarged portion is insufficient, the liquid filling of the downstream enlarged portion may have to be repeated. Therefore, most of the liquid downstream from the bubbles must be discarded, wasting a relatively large amount of liquid.

According to the method of the present invention, the first preliminary filling step is first executed for preliminarily filling the first enlarged portion with the liquid. Then, the second preliminary filling step is carried out for discharging the bubbles (removing the air layer) from the first enlarged portion and preliminarily filling the second enlarged portion. Finally, the complete filling step is executed for filling the supply passage entirely with the liquid. In other words, in the first enlarged portion, the second preliminary filling step can be regarded as a part of the complete filling step. As has been described, by performing the preliminary filling steps in correspondence with the enlarged portions and filling the enlarged portions with the liquid continuously from an end of the supply passage corresponding to the liquid container, the bubbles are reliably discharged continuously from the upstream end of the supply passage. The supply passage is thus filled with the liquid efficiently and reliably.

A second aspect of the present invention is a liquid ejection apparatus. The apparatus includes a supply passage for supplying a liquid from a liquid container that retains the liquid to a nozzle that ejects the liquid. The apparatus further has a filling device for filling the supply passage with the liquid supplied from the liquid container. The filling device operates to move the edge of the liquid to a preliminary position between a bubble trapping portion in the supply passage in which bubbles are trapped and the nozzle, and then fill the supply passage entirely with the liquid.

In the liquid ejection apparatus, the liquid filling is suspended at a position between the bubble trapping portion and the nozzle. The bubble trapping portion in which the bubbles are easily trapped (the air layer is easily formed) is thus reliably filled with the liquid. The supply passage is then filled entirely with the liquid. This reduces the amount of the liquid discarded unnecessarily. The supply passage is thus filled with the liquid efficiently.

A third aspect of the present invention is a liquid ejection apparatus. The apparatus includes a supply passage for supplying a liquid from a liquid container that retains the liquid to a nozzle that ejects the liquid. The apparatus further has a filling device for filling the supply passage with the liquid supplied from the liquid container. The supply passage includes a tubular line and an enlarged portion communicating with the tubular line and having a width larger than the width of the tubular line. The filling device operates to move the edge of the liquid to a position between the enlarged portion and the nozzle in the supply passage and then fill the supply passage entirely with the liquid.

In the liquid ejection apparatus, the liquid filling is suspended at a position between the enlarged portion and the nozzle. The enlarged portion in which the bubbles are easily trapped (the air layer is easily formed) is thus reliably filled with the liquid. The supply passage is then filled entirely with the liquid. This reduces the amount of the liquid discarded unnecessarily. The supply passage is thus filled with the liquid efficiently.

It is preferred that the apparatus further includes suction means for drawing a gas and the liquid from the supply passage through the nozzle and an open-close valve capable of closing a portion of the supply passage in cooperation with the suction means. It is also preferred that the enlarged portion have a flexible film for changing the volume of the enlarged portion.

In the liquid ejection apparatus, suction is performed by the suction means with the supply passage closed by the open-close valve, or choke suction is conducted. This reduces the amount of the liquid discarded unnecessarily when the liquid filling is performed. Further, the supply passage is efficiently filled with the liquid.

Also, if the enlarged portion includes the flexible film for changing the volume of the enlarged portion, the flexible film elastically deforms inwardly with respect to the enlarged portion in correspondence with a pressure drop in the enlarged portion. This positively discharges the air from the enlarged portion, further improving the liquid filling performance.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to the attached drawings. The invention is not restricted to the illustrated embodiment that includes different technical restrictions, unless otherwise specified.

(Liquid Ejection Apparatus)

Figure 1:
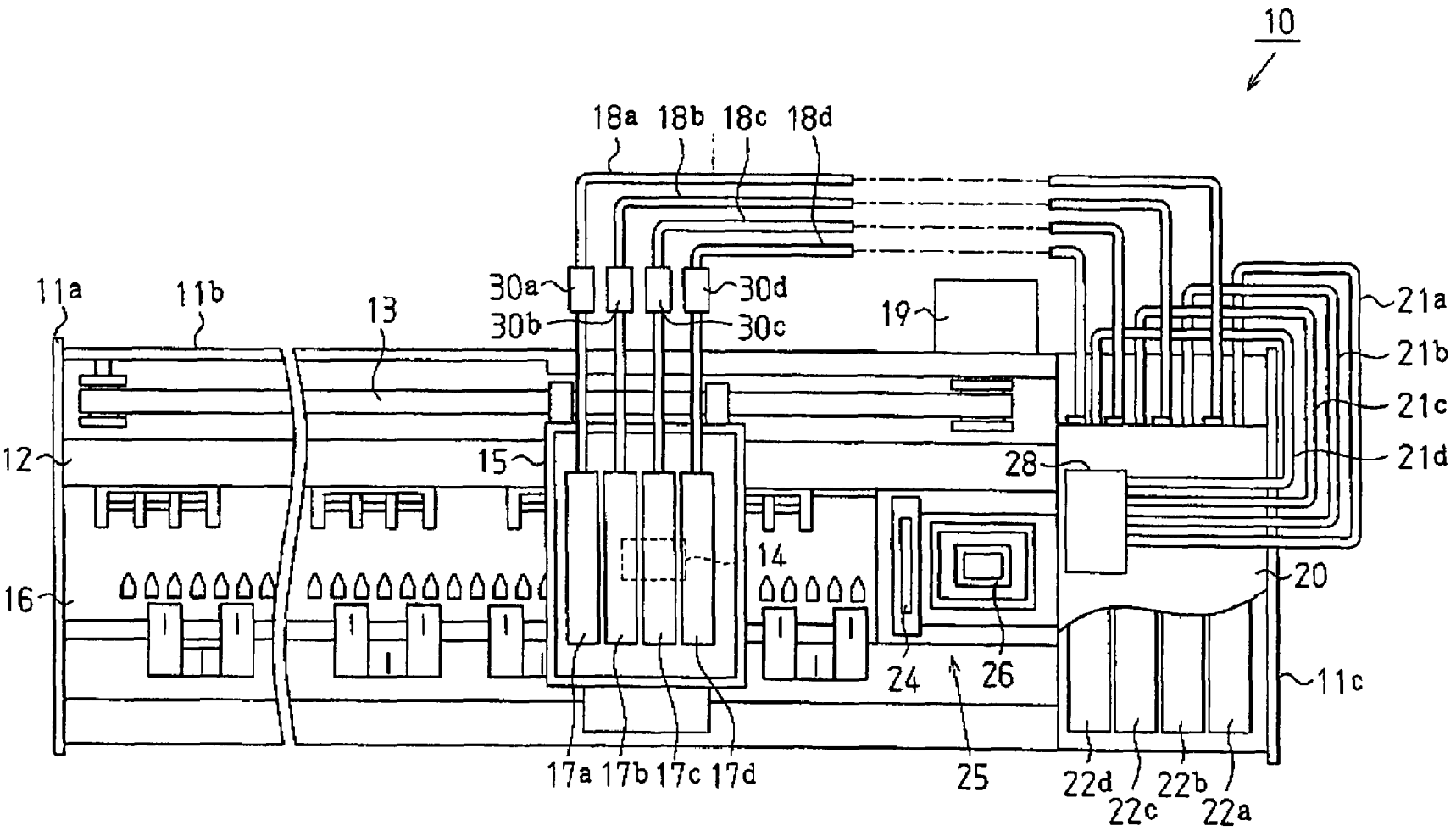
FIG. 1 is a plan view schematically showing a liquid ejection apparatus according to an embodiment of the present invention.

A liquid ejection apparatus according to the present invention will hereafter be described as a whole, with reference to FIG. 1, which is a plan view schematically showing an example of the liquid ejection apparatus.

A printer 10, or the liquid ejection apparatus, includes frames 11*a*, 11*b*, 11*c* and a platen 16 provided in the space defined by the frames 11*a* to 11*c*. The platen 16 supports a recording medium such as a paper sheet at a certain position in such a manner that ink, or liquid, is ejected to the recording medium at the position.

A carriage 15 is arranged as opposed to the platen 16 and includes an ejection head 14. The carriage 15 is supported by a guide shaft 12 connected to inner surfaces of the frames 11*a*, 11*c*. The carriage 15 reciprocates along the guide shaft 12 as powered by a carriage drive motor 19 through a belt 13. In this manner, the ejection head 14 formed in the carriage 15 moves relative to the recording medium and ejects the ink to the recording medium, thus performing printing in a desired manner.

The printer 10 employs different color inks, for example four color inks of black, magenta, cyan, and yellow, and thus performs color printing. Each of the color inks is retained in a corresponding one of ink cartridges 22*a*, 22*b*, 22*c*, 22*d*, which are detachable liquid containers. The ink cartridges 22*a* to 22*d* are held in a cartridge holder 20, which is located at the right side of FIG. 2. Supply tubes 18*a*, 18*b*, 18*c*, 18*d* extend from the cartridge holder 20 in correspondence with the ink cartridges 22*a* to 22*d*. Each of the supply tubes 18*a* to 18*d* is connected to a corresponding one of pressure adjustment mechanisms 17*a*, 17*b*, 17*c*, 17*d*, which are formed on the carriage 15, through an associated one of choke mechanisms 30*a*, 30*b*, 30*c*, 30*d*. The pressure adjustment mechanisms 17*a* to 17*d* are connected to an ejection head 14 through a communication passage 27 (see FIG. 2). This structure allows the ink to be supplied from the ink cartridges 22*a* to 22*d* to the ejection head 14 and then elected from a nozzle 33 (FIG. 2) as liquid droplets.

The printer 10 includes a pressurization pump unit 28, which is located above the cartridge holder 20 (closer to the viewer as viewed in FIG. 1). The pressurization pump unit 28 supplies compressed air to the interior of each of the ink cartridges 22*a* to 22*d* through a corresponding one of air supply tubes 21*a*, 21*b*, 21*c*, 21*d* and the cartridge holder 20. The pressurization pump unit 28 is formed by, for example, a diaphragm pump and a pressure adjustment regulator and adjusts the pressure in each ink cartridge 22*a* to 22*d*.

As shown in FIG. 1, the printer 10 has a maintenance unit 25 arranged in a right portion of the platen 16. FIG. 1 shows a cap 26 and a wiper 24 of the maintenance unit 25. The cap 26 is capable of sealing a nozzle surface 35 (see FIG. 2) of the ejection head 14 and prevents nozzle clogging before initial use of the ejection head 14. The cap 26 is used in ink suction in which the nozzle surface 35 is sealed by the cap 26 and the interior of the cap 26 is depressurized, thus drawing and discharging foreign objects and bubbles from the nozzle 33, together with the ink. The wiper 24 wipes off the liquid droplets from the nozzle surface 35 of the ejection head 14, after the suction is performed, for example.

Figure 2:
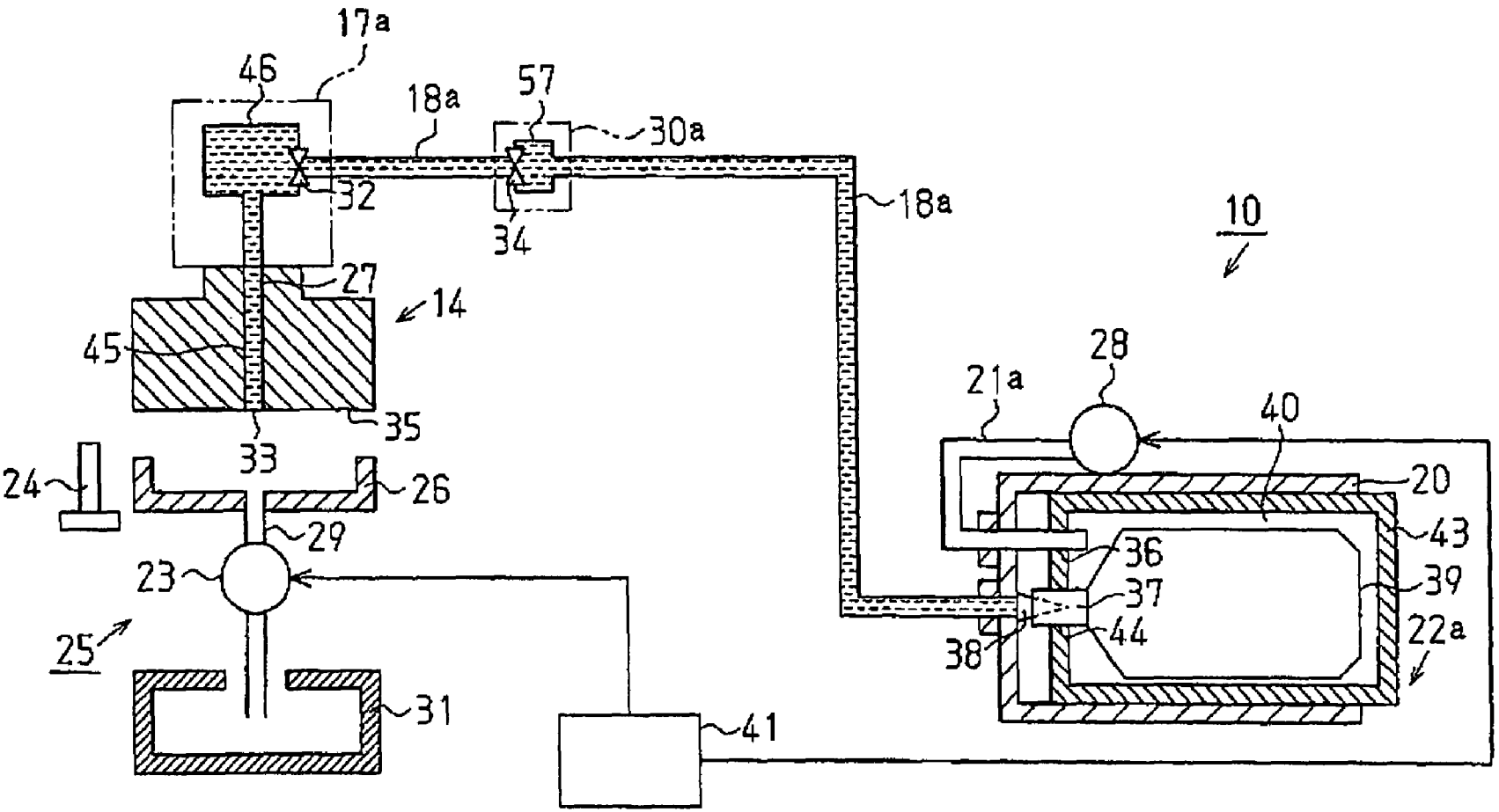
FIG. 2 is a diagrammatic view representing an ink supply system and a liquid discharge system of the printer.

An ink supply system and a liquid discharge system of the printer 10 will now be described with reference to FIGS. 2 to 4. The description focuses on the ink cartridge 22*a* and does not include the other ink cartridges 22*b* to 22*d* for avoiding redundancy. FIG. 2 is a diagrammatic view representing the ink supply system and the liquid discharge system of the printer 10.

Referring to FIG. 2, the ink cartridge 22*a* is formed by accommodating an ink pack 39 in a casing 43 formed of, for example, plastic. The ink pack 39 is formed by a flexible film that is shaped like a pack through welding. The ink pack 39 retains the ink and sends the ink from an outlet portion 37. A distal end of the outlet portion 37 projects outward from the casing 43 through a through hole 44 defined in the casing 43. The distal end is separably coupled with a coupling portion 38 projecting from an inner surface of the cartridge holder 20. The coupling portion 38 is formed by a hollow needle-like member and communicates with a supply tube 18*a*. An air supply tube insertion hole 36 is defined in the casing 43 of the ink cartridge 22*a* and receives an end of the air supply tube 21*a*.

Therefore, when the ink cartridge 22*a* is installed in the cartridge holder 20 as illustrated in FIG. 2, the coupling portion 38 is coupled with the outlet portion 37. The corresponding end of the air supply tube 21*a* is inserted into an interior space 40 of the casing 43 through the air supply tube insertion hole 36. In this state, the interior space 40 of the ink cartridge 22*a* is held in an airtight state. Thus, when the compressed air is supplied from the pressurization pump unit 28 to the ink cartridge 22*a* through the air supply tube 21*a*, the pressure in the interior space 40 rises and thus pressurizes the ink in the ink pack 39 through a film surface of the ink pack 39. In this manner, the ink is supplied from the ink pack 39 to the supply tube 18*a* through the outlet portion 37 and the coupling portion 38, in a pressurized state. The air supply pressure of the pressurization pump unit 28 is controlled by a controller 41. That is, the controller 41 controls the ink supply pressure.

The choke mechanism 30*a* having an open-close valve 34 is provided in the supply tube 18*a*. The configuration and the operation of the choke mechanism 30*a* will hereafter be explained referring to FIGS. 3(*a*) and 3(*b*), each of which is a cross-sectional view showing a main portion of the choke mechanism 30*a*.

Figure 3A:
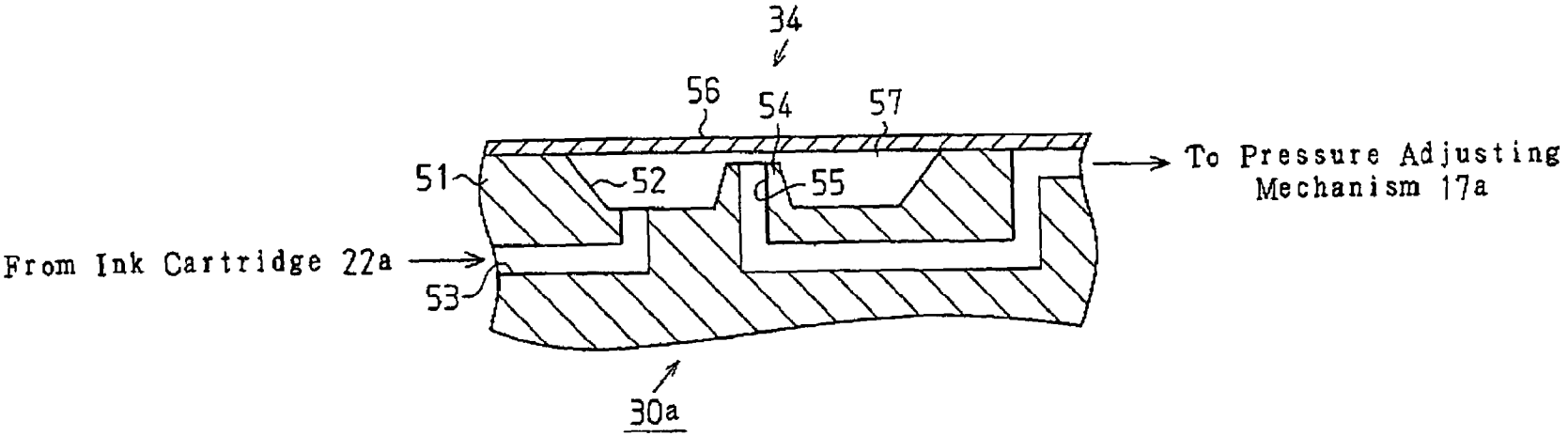
FIGS. 3(*a*) and 3(*b*) are cross-sectional views each showing a main portion of a choke mechanism.
Figure 3B:
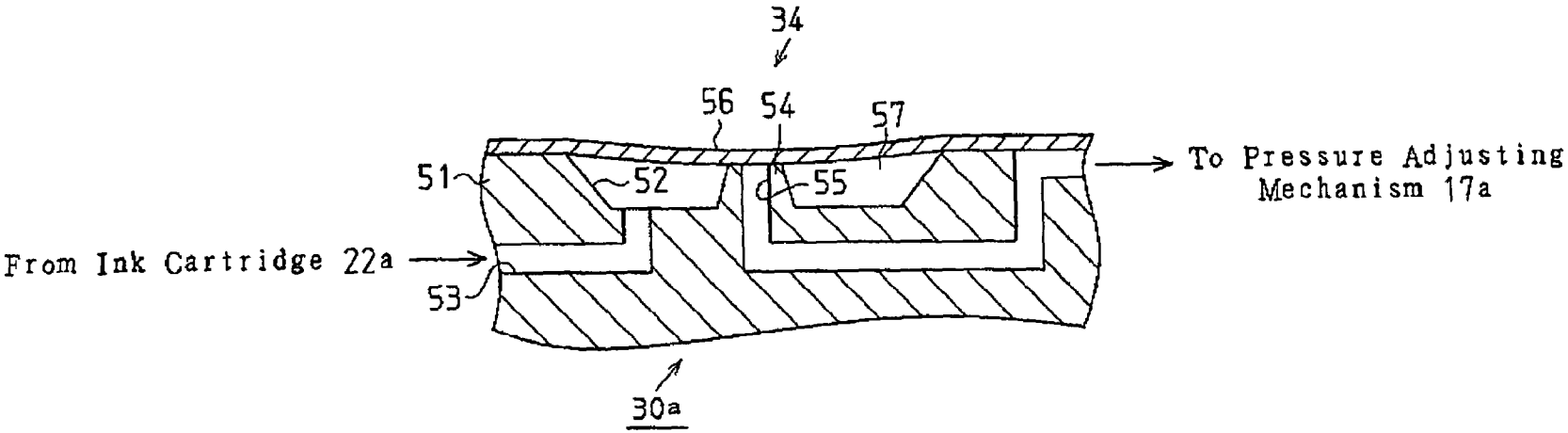

As shown in FIG. 3(*b*), the choke mechanism 30*a* has a synthetic resin base 51. A recess 52 is defined in a side surface of the base 51. An inlet line 53 is defined in the bottom of the recess 52 and extends through the base 51. The inlet line 53 communicates with a portion of the supply tube 18*a* closer to the ink cartridge 22*a* (see FIG. 2). A projection 54 projects from the bottom of the recess 52. An outlet line 55 is defined in the projection 54 and has an opening corresponding to an upper surface of the projection 54. The outlet line 55 extends through the base 51 and communicates with a portion of the supply tube 18*a* closer to the pressure adjustment mechanism 17*a* (see FIG. 2).

As shown in FIG. 3(*b*), the recess 52 is closed by fixing a flexible film 56 to a side surface of the base 51 in a state elastically deformed toward the projection 54. In this state, a second pressure chamber 57 is defined in a sealed state by a wall surface of the recess 52 and the film 56. When the ink is not supplied to the second pressure chamber 57, the inlet line 53 is blocked from the outlet line 55 referring to FIG. 3(*b*).

When the ink is supplied from the ink cartridge 22*a* to the choke mechanism 30*a*, the ink flows into the second pressure chamber 57 through the inlet line 53. As the amount of the ink in the second pressure chamber 57 increases, the film 56 separates from the projection 54, as shown in FIG. 3(*a*), thus connecting the inlet line 53 to the outlet line 55.

The open-close valve 34 operates as has been described. More specifically, when the ink supply pressure of the ink cartridge 22*a* is higher than a predetermined level, the open-close valve 34 supplies the ink to the pressure adjustment mechanism 17*a*. Contrastingly, when the ink supply pressure of the ink cartridge 22*a* is lower than the predetermined level, the open-close valve 34 shuts the ink supply to the pressure adjustment mechanism 17*a*. In this manner, the choke mechanism 30*a* controls switching of the ink supply between a permitted state and a prohibited state (a choked state), together with the controller 41 that controls the ink supply pressure.

Referring to FIG. 2, the ink is supplied from the ink cartridge 22*a* to the pressure adjustment mechanism 17*a* through the choke mechanism 30*a*. At this stage, the ink supply pressure is higher than the atmospheric head. Thus, if the ink is supplied to the ejection head 14 at this pressure, the ink leaks from the nozzle 33 of the ejection head 14 and thus ink ejection cannot be controlled properly. For avoiding this, the pressure adjustment mechanism 17*a* depressurizes the ink by a pressure adjustment valve 32 formed in the pressure adjustment mechanism 17*a* for adjusting the liquid pressure in a first pressure chamber 46, in such a manner that the ink in the nozzle 33 is maintained under appropriate negative pressure (relative to the atmospheric pressure).

The configuration of the pressure adjustment mechanism 17*a* will hereafter be schematically described with reference to FIG. 4.

Figure 4:
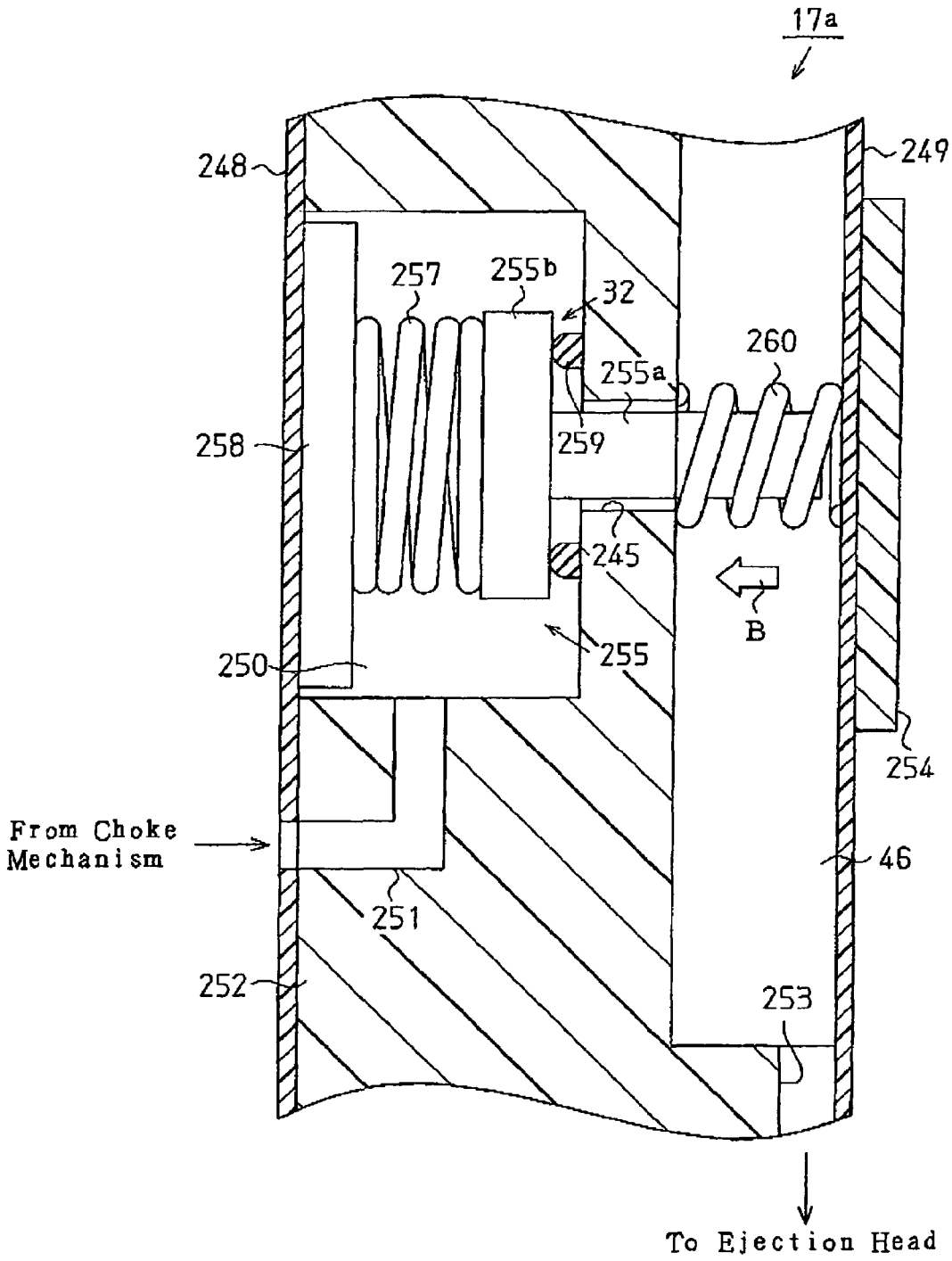
FIG. 4 is a cross-sectional view showing a main portion of a pressure adjustment mechanism.
Figure 5A:
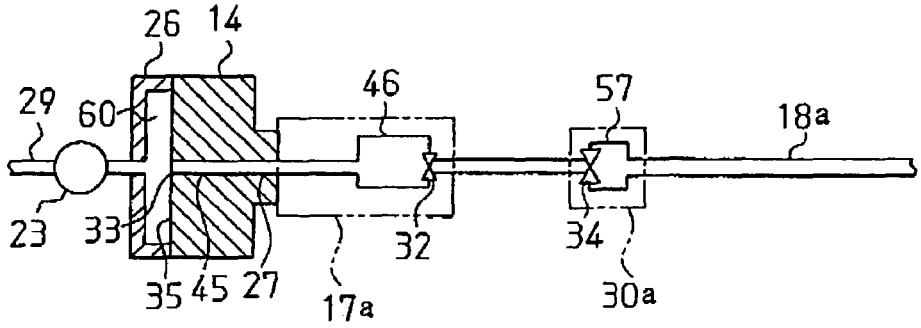
FIGS. 5(*a*) to 5(*d*) are views showing change of the ink edge in a supply passage when initial ink filling is performed.
Figure 5B:
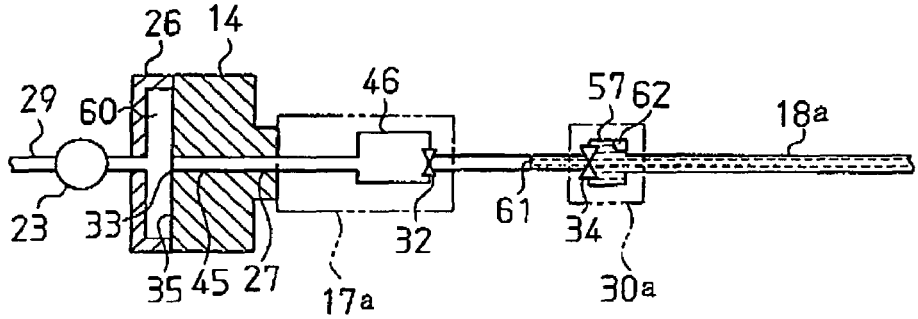
Figure 5C:
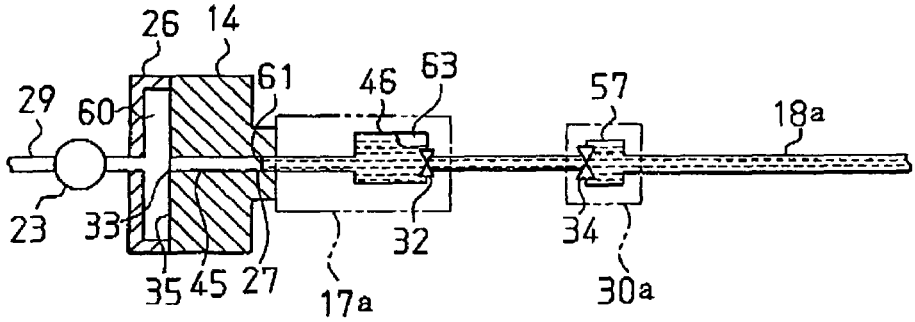
Figure 5D:
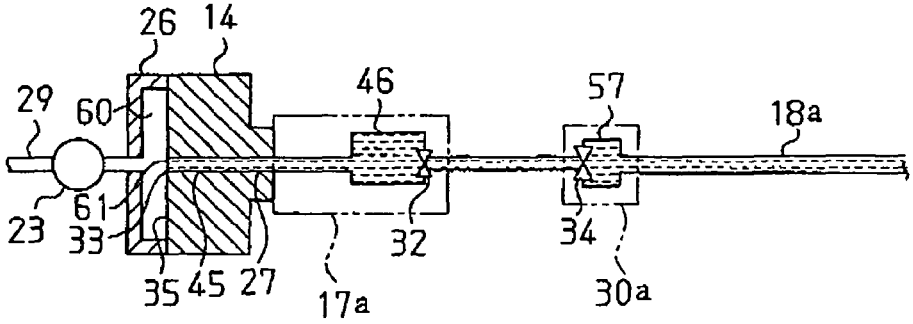

As shown in FIG. 4, the pressure adjustment mechanism 17*a* includes a synthetic resin base 252, films 248, 249, and a pressure receiving plate 254 bonded with the film 249. The films 248, 249 are welded to opposing surfaces of the base 252. The base 252 includes an inlet line 251, an inlet chamber 250, the first pressure chamber 46, a through hole 245, and an outlet line 253. The inlet line 251 introduces the ink from the choke mechanism 30*a* to the inlet chamber 250. The through hole 245 connects the inlet chamber 250 with the first pressure chamber 46. The outlet line 253 sends the ink from the first pressure chamber 46 to the ejection head 14 (see FIG. 2).

The pressure adjustment valve 32 of the pressure adjustment mechanism 17*a* is configured as follows. The pressure adjustment valve 32 includes a valve body 255 having a shaft portion 255*a* and a disk portion 255*b*. The shaft portion 255*a* is received in the through hole 245 and the disk portion 255*b* is formed at a proximal end of the shaft portion 255*a*. A spring 257 is clamped between the disk portion 255*b* of the valve body 255 and a spring seat 258. That is, opposing ends of the spring 257 contact the disk portion 255*b* and the spring seat 258. Referring to FIG. 4, the elastic force generated by the spring 257 in a compressed state urges the valve body 255 rightward as viewed in FIG. 4. In this state, the disk portion 255*b* disconnects the inlet chamber 250 from the first pressure chamber 46 through a seal member 259. The pressure adjustment valve 32 is thus held in a closed state.

A distal end of the shaft portion 255*a* of the valve body 255 opposes the pressure receiving plate 254 through the film 249, which is a flexible film. The pressure receiving plate 254 is movable in correspondence with elastic deformation of the film 249.

More specifically, when the ink is supplied from the outlet line 253 to the ejection head 14 (see FIG. 2) and the pressure in the first pressure chamber 46 decreases, the film 249 elastically deforms inwardly, thus moving the pressure receiving plate 254 in a direction indicated by arrow B in FIG. 4. In this state, since the pressure receiving plate 254 receives reactive force produced by the spring 260, the shaft portion 255*a* of the valve body 255 is prevented from being pressed immediately. However, as the difference between the pressure in the first pressure chamber 46 and the atmospheric pressure becomes larger, the movement amount of the pressure receiving plate 254 becomes greater. The valve body 255 thus starts to move in the direction of arrow B. When the difference between the pressure in the first pressure chamber 46 and the atmospheric pressure exceeds a predetermined level, the pressing force generated by the pressure receiving plate 254 exceeds the urging force of the spring 257. The disk portion 255*b* is thus separated from the seal member 259, switching the pressure adjustment valve 32 to an open state. In this state, the ink flows from the inlet chamber 250 to the first pressure chamber 46 through the through hole 245, thus compensating the pressure in the first pressure chamber 46. This switches the pressure adjustment valve 32 back to the closed state. In this manner, the pressure in the first pressure chamber 46 is maintained at a constant level by repeating valve closure for depressurization of the first pressure chamber 46 and valve opening for pressure compensation in the first pressure chamber 46.

Referring to FIG. 2, after the pressure of the ink is adjusted to the appropriate level by the pressure adjustment mechanism 17*a*, the ink flows through the communication passage 27 and a segment passage 45 including a cavity (a pressure chamber) defined in each nozzle. The ink is then ejected or discharged from the nozzle 33 through an ejection control procedure or ink suction. Although the ejection head 14 actually includes multiple communication passages 27, multiple segment passages 45, and multiple nozzles 33, the drawing shows these passages and nozzles as a single line for the illustrative purposes.

As has been described, the ink supply passage includes tubular lines such as the supply tube 18*a* and the communication passage 27, as well as enlarged portions, or enlarged lines, such as the second pressure chamber 57 of the choke mechanism 30*a* and the first pressure chamber 46 of the pressure adjustment mechanism 17*a*. The second pressure chamber 57, or a first enlarged portion, and the first pressure chamber 46, or a second enlarged portion, each include a portion in which an air layer is easily formed through bubble accumulation. That is, if, for example, the pressure adjustment mechanism 17*a* of FIG. 4 is oriented vertically, the bubbles are trapped (the air layer is formed) in an upper section of the first pressure chamber 46 due to buoyancy. It is thus difficult to remove the bubbles from the first pressure chamber 46. The bubbles may flow into the ejection head 14 when printing is performed, resulting in an ejection problem. Therefore, when initial ink filling is performed as will be described later, it is required that the ink filling be carried out reliably without trapping bubbles in the enlarged portions.

As shown in FIG. 2, the liquid discharge system of the printer 10 is formed mainly by the maintenance unit 25 of FIG. 1. The maintenance unit 25 includes the cap 26, a waste liquid tube 29, a suction pump 23, a waste liquid tank 31, and a wiper 24 formed by, for example, a rubber blade. The cap 26 has a through hole extending through the center of the cap 26 and is capable of sealing the nozzle surface 35 of the ejection head 14. The waste liquid tube 29 communicates with the through hole of the cap 26. The suction pump 23 is provided in the waste liquid tube 29. The waste liquid tank 31 receives a distal end of the waste liquid tube 29. The suction pump 23 is formed by, for example, a tube pump. The controller 41 controls operation of the suction pump 23.

When suction is performed, the nozzle surface 35 is sealed by the cap 26 and the suction pump 23 is actuated. This depressurizes the sealed space defined by the nozzle surface 35 and the cap 26, thus drawing the ink from the nozzle 33. In other words, the cap 26, the waste liquid tube 29, and the suction pump 23 form suction means. The suction means and the controller 41 form filling means. If the ink suction is performed with the open-close valve 34 of the choke mechanism 30*a* held in an open state, the ink is continuously supplied from the unused ink cartridge 22*a* to the supply passage and thus continuously flows in the supply passage.

Contrastingly, if the suction is performed with the open-close valve 34 of the choke mechanism 30*a* held in a closed state, the ink flow from the nozzle 33 stops after a relatively short time, thus generating relatively great negative pressure (the absolute value of which is small) in the first pressure chamber 46 and the communication passage 27. When the open-close valve 34 is opened quickly in this state, the ink starts to flow from the nozzle 33 rapidly, thus discharging the bubbles from the nozzle 33 effectively. Hereinafter, this operation, or temporarily closing the supply passage before allowing the ink to flow in the supply passage, will be referred to as "intense suction". The intense suction is different from normal ink suction (referred to as "normal suction") in which the suction is started with the supply passage held in an open state.

(Initial Ink Fill)

The initial ink filling of the printer 10 will hereafter be explained with reference to FIGS. 5(*a*) to 5(*d*). The initial ink filling is defined as filling the supply passage with the ink supplied from the ink cartridges 22*a* to 22*d* when the printer 10 is initially used. In some cases, the supply passage of the printer 10 may be filled with preservative liquid (that has been originally introduced into the supply passage) before the initial ink fill. In other cases, the supply passage of the printer 10 may be empty (or retain gas) before the initial ink fill. The illustrated embodiment will be explained for the latter cases.

FIGS. 5(*a*) to 5(*d*) show change of the ink edge in the supply passage of the printer 10 when the initial ink filling is performed. As shown in FIG. 5(*a*), the supply passage is empty at an initial stage of the ink fill. The ink filling is performed through the normal suction or the intense suction, which have been described above. More specifically, the initial ink filling is carried out by depressurizing a space 60 defined in the vicinity of the nozzle 33 and sealed by the cap 26, thus drawing the air and the ink through the supply passage.

First, as shown in FIG. 5(*b*), the ink is supplied until a meniscus 61 (the ink edge) moves to a position (a preliminary position) between the second pressure chamber 57 of the choke mechanism 30*a*, or the first enlarged portion, and the first pressure chamber 46 of the pressure adjustment mechanism 17*a*, or the second enlarged portion (a first preliminary filling step). The goal of the first preliminary filling step is to preliminarily fill a portion of the supply passage from each ink cartridge 22*a* to 22*d* to the second pressure chamber 57 with the ink. The term "preliminary filling" indicates that the ink filling of the second pressure chamber 57 is incomplete and a relatively small amount of bubbles 63 are trapped in the second pressure chamber 57 at this stage. Further, it is preferred that the position (the preliminary position) of the meniscus 61 after the first preliminary filling step be located closer to the second pressure chamber 57. However, the position is actually set at a location farther than the preferred position with respect to the second pressure chamber 57, so as to cancel variation of the liquid edges among the multiple supply passages provided in correspondence with the different color inks.

Next, as shown in FIG. 5(*c*), the ink is supplied until the meniscus 61 moves to a position (a preliminary position) between the first pressure chamber 46 and the nozzle 33 (a second preliminary filling step). The goal of the second preliminary filling step is to preliminarily fill a portion of the supply passage from the ink cartridge 22*a* to 22*d* to the first pressure chamber 46 with the ink and to move the bubbles from the second pressure chamber 57 to a portion of the supply passage closer to the nozzle 33 (hereinafter referred to as a "downstream side" of the supply passage). In other words, in the second pressure chamber 57, the second preliminary filling step functions as part of the complete filling step. At this stage, the first pressure chamber 46 is held in a state preliminarily filled with the ink with a relatively small amount of bubbles 63 trapped in the first pressure chamber 46.

Then, as shown in FIG. 5(*d*), the ink is supplied to the supply passage in such a manner as to fill the supply passage entirely with the ink, thus removing the air from the supply passage including the bubbles 63 trapped in the first pressure chamber 46 (a complete filling step). The complete filling step may be divided into multiple sub-steps. After the complete filling step, suction for drawing a relatively small amount of ink from the nozzle 33, as well as wiping, may be performed if necessary. In this manner, the initial ink filling is completed.

As has been described, the bubbles are easily trapped (the air layer is easily formed) particularly in the second pressure chamber 57 of the choke mechanism 30*a* and the first pressure chamber 46 of the pressure adjustment mechanism 17*a*, compared to the remaining portions of the supply passage. It is thus extremely difficult to completely fill the supply passage with the ink only by a single cycle of suction. If the amount of the ink flow (the ink discharge flow) generated through suction is increased, the amount of the ink passing through the first and second pressure chambers 46, 57 is increased. However, the ink flow in the vicinity of the bubbles becomes constant after a certain period of time, making it difficult to discharge the bubbles. In order to solve this problem, it is effective to perform a plurality of cycles of suction for producing pulsation in the ink flow, which acts to discharge the bubbles. Even in this case, however, the ink downstream from the bubbles not only hampers but also adversely influences discharge of the bubbles (as will be later explained in detail). Also, the ink is eventually discarded as waste ink.

In the illustrated embodiment, pulsation is caused in the ink flow for discharging the bubbles from the first and second pressure chambers 46, 57, like the prior art. However, unlike the prior art, in each of the preliminary filling steps of the illustrated embodiment, the ink is supplied preliminarily to the corresponding one of the first and second pressure chambers 46, 57 while the ink flow to a further downstream position is maximally suppressed. That is, in the illustrated embodiment, the bubble discharge from the first and second pressure chambers 46, 57 is performed in the complete filling with the liquid edge held at the preliminary position, unlike the prior art in which such bubble discharge is carried out after the liquid edge reaches the nozzles. In other words, in the illustrated embodiment, the bubbles are discharged with only a small amount of ink held in a portion downstream from the bubbles. Accordingly, compared to the prior art, the illustrated embodiment decreases the amount of discarded ink.

Further, if, like the illustrated embodiment, the supply passage includes multiple portions in which the bubbles easily accumulate, the bubbles discharged from the second pressure chamber 57 located closer to the ink cartridges (upstream) may be re-trapped in the first pressure chamber 46, which is located downstream. Therefore, if the ink filling of the second pressure chamber 57 is insufficient, the ink filling of the first pressure chamber 46 may have to be repeated. In this case, most of the ink held in a downstream area including the first pressure chamber 46 must be discarded, wasting a relatively large amount of ink. So as to avoid this, it is required that the ink filling of the supply passage be performed reliably and continuously from an upstream side of the supply passage.

In the illustrated embodiment, the first preliminary filling step is executed for the second pressure chamber 57 located upstream and the second preliminary filling step is carried out for the first pressure chamber 46 located downstream. The ink filling is thus performed reliably and continuously from the upstream side.

The first and second preliminary filling steps and the complete filling step may be performed through either the normal suction or the intense suction. However, since the intense suction is highly efficient in the ink fill, the ink filling of the illustrated embodiment is carried out through the intense suction. The intense suction will hereafter be specifically explained, for the second preliminary filling step, by way of example, with reference to FIGS. 5(*a*) to 5(*d*) and FIG. 6.

Figure 6:
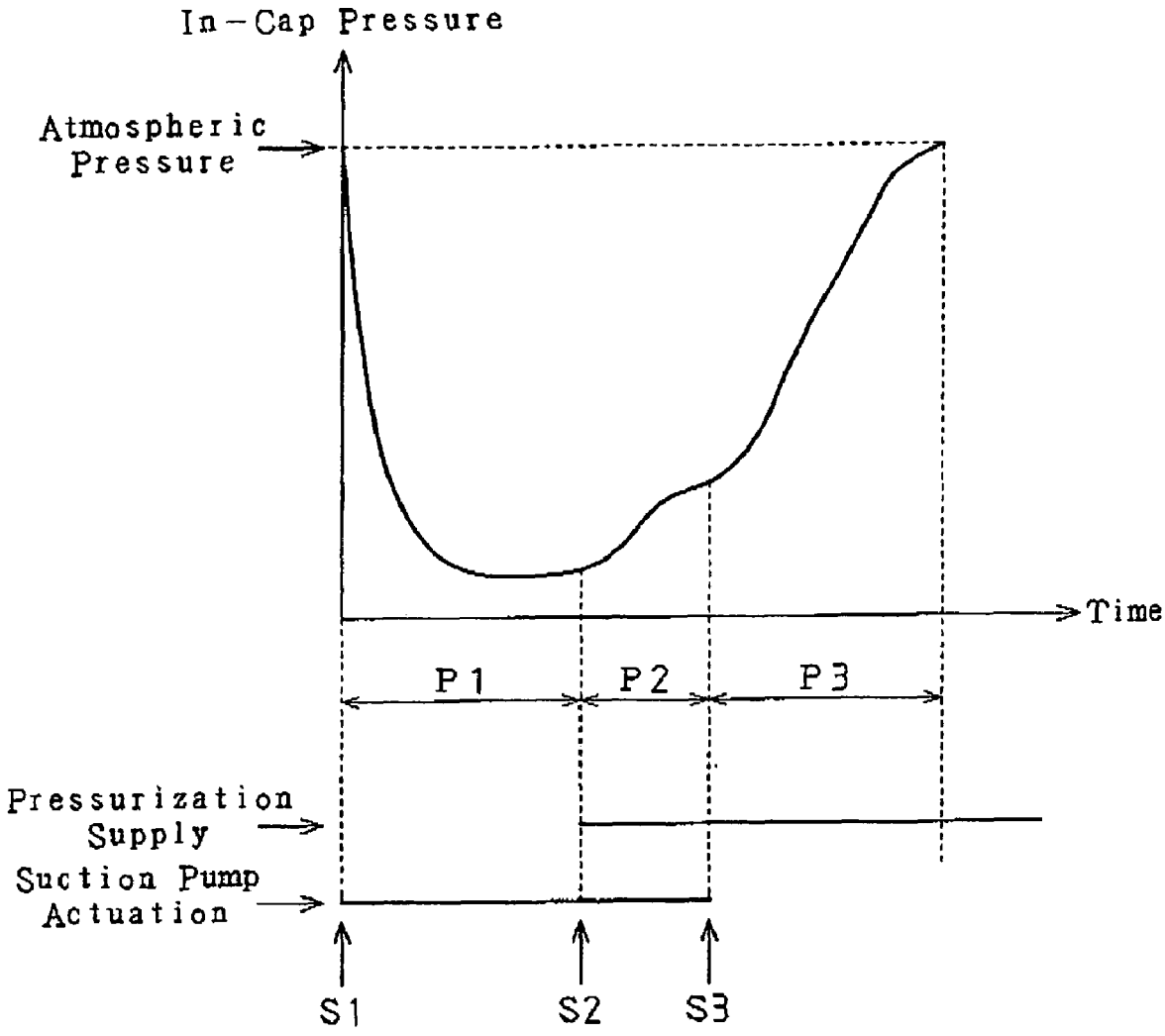
FIG. 6 is a timing chart showing change of the pressure in a cap when intense suction is performed and timings at which pressurization and suction pump actuation are executed.

FIG. 6 is a timing chart representing change of the pressure in the cap when the intense suction is performed and the timings at which pressurization supply and suction pump actuation are conducted. The "pressurization supply" is defined as pressurization of the ink cartridge 22*a* by the pressurization pump unit 28 of FIG. 2, which is controlled by the controller 41.

The intense suction of the second preliminary filling step is started in the state of FIG. 5(*b*), subsequent to the first preliminary filling step. More specifically, it is determined whether or not the pressurization supply of the ink is being performed. If the determination is negative, the suction pump 23 is actuated (in step S1 of FIG. 6). If the determination is positive, the pressurization supply is suspended and then the suction pump 23 is actuated (in step S1 of FIG. 6).

In the state of FIG. 5(*b*), when the suction pump 23 is actuated, the space 60 is depressurized and the meniscus 61 starts to move downstream. However, as long as the pressurization supply is not being performed, the open-close valve 34 of the choke mechanism 30*a* is switched to the closed state of FIG. 3(*b*) after a relatively short time, thus stopping the ink flow correspondingly. In this state, as indicated in a choke suction step P1 of FIG. 6, negative pressure rapidly accumulates in a portion downstream from the open-close valve 34, thus approximating a constant level.

If the suction pump 23 is actuated when the pressurization suction is being performed, the open-close valve 34 is maintained in an open state and the normal suction is performed. In other words, in the printer 10, switching between the intense suction and the normal suction depends on whether or not the pressurization suction is being performed when the suction pump is actuated.

In the choke suction step P1, the film 249, or the flexible film, of the pressure adjustment mechanism 17*a* of FIG. 4 is greatly deformed in the direction of arrow B, by the negative pressure in the first pressure chamber 46 that has been greatly increased. The first pressure chamber 46 is thus held in a greatly squeezed state. In this manner, the air is positively discharged from the first pressure chamber 46 by increasing the negative pressure in the first pressure chamber 46. This improves the ink filling performance when the ink filling is performed later.

After the suction pump 23 is operated for a predetermined time, the pressurization suction is started with the suction pump 23 continuously running, in step S2 of FIG. 6. The open-close valve 34 of the choke mechanism 30*a* is then switched to the open state of FIG. 3(*a*). A rapid ink flow is thus caused in correspondence with the difference between the negative pressure accumulated in the supply passage and the supply pressure acting at an upstream side. The ink flow discharges the bubbles 63 from the second pressure chamber 57 of the choke mechanism 30*a* and gradually fills the first pressure chamber 46 of the pressure adjustment mechanism 17*a* preliminarily, as shown in FIG. 5(*c*) (in great negative pressure suction step P2 of FIG. 6). Meanwhile, the negative pressure accumulated in the choke suction step P1 is compensated by the ink flow and the ink flow thus gradually becomes constant. In the illustrated embodiment, since the suction pump 23 is operated continuously before and after step S2, the speed for compensating the negative pressure becomes relatively low, thus maintaining the bubble discharge performance.

Once the ink flow becomes constant, the ink flow in the vicinity of the bubbles 63 in the first pressure chamber 46 also becomes constant, making it difficult to discharge the bubbles 63 from the first pressure chamber 46. Therefore, even if the ink flow is further continuously generated, the liquid edge simply moves downstream without moving the bubbles 63 without discharging the bubbles. The ink downstream from the bubbles 63 is discarded as waste ink in the complete filling step in which the bubbles 63 are discharged from the nozzle 33. It is thus undesirable to move the liquid edge unnecessarily downstream. In order to solve this problem, the suction pump 23 is stopped at a predetermined timing indicated by step S3 of FIG. 6. Then, after releasing the negative pressure in negative pressure release step P3 of FIG. 6, the meniscus 61 is stopped at the position shown in FIG. 5(*c*). The second preliminary filling step is thus ended.

When the complete filling step is performed after the second preliminary filling step, the bubbles 63 are efficiently discharged from the first pressure chamber 46 by performing the intense suction. Further, when switching from the second preliminary filling step to the complete filling step, the pressurization supply may be suspended in the negative pressure release step P3 and the suction pump 23 is re-actuated for starting the choke suction step. That is, in the present invention, the suction does not necessarily have to be stopped completely before the complete filling step is started after the preliminary filling step. The complete filling step may be started as long as the liquid edge has been substantially moved to a different position in the second preliminary filling step.

An adverse influence by the ink downstream from the bubbles on the bubble discharge performance will now be explained.

When the ink filling is carried out and the air and the ink flow in the supply passage, hydrodynamic resistance is produced. The resistance (head loss) depends on fluid viscosity or the like and is relatively great for liquid such as the ink but is substantially zero for the air (gas). That is, the resistance caused against movement of the ink is varied in correspondence with the ink edge in the supply passage. In other words, as the liquid edge, or the meniscus 61, moves to a further downstream position, the ink movement is more hampered and the bubble discharge performance is more lowered. As is clear from this fact, the ink filling of the first and second pressure chambers 46, 57, in which the bubbles easily accumulate, is efficiently performed with the air maintained in a downstream portion of the supply passage, compared to a case in which such ink filling is performed after the ink is supplied entirely to the supply passage.

In the illustrated embodiment, the bubbles are discharged from the first and second pressure chambers 46, 57 through pulsation of the ink flow like the prior art. However, in the preliminary filling steps of the illustrated embodiment, the first and second pressure chambers 46, 57 are preliminarily filled with the ink while maximally suppressing change of the liquid edge to a further downstream position. That is, unlike the prior art in which the bubbles are discharged from the first and second pressure chambers 46, 57 after the liquid edge reaches the nozzle, the bubble discharge from the first and second pressure chambers 46, 57 is initiated in the complete filling step with the liquid edge maintained at the corresponding preliminary position. Accordingly, in the complete filling step of the illustrated embodiment, such bubble discharge is performed at a relatively high speed with improved effects, compared to the prior art. The ink filling is thus efficiently achieved in the illustrated embodiment.

The intense suction may cause the following problems. The rapid ink flow generated in the great negative pressure suction step is obtained only for a relatively short time after the pressurization supply is started and the open-close valve 34 is opened. It must be carefully determined with which time of the ink filling the time for causing the rapid ink flow is synchronized. For example, if the intense suction is started in the state of FIG. 5(*a*), the rapid ink flow is canceled when the ink reaches the second pressure chamber 57. The second pressure chamber 57 thus cannot be filled completely. However, in the illustrated embodiment, the choke suction step and the great negative pressure suction step are started in the state of FIG. 5(*b*) in which the second pressure chamber 57 has been preliminarily filled in the first preliminary filling step. The intense suction is thus performed effectively.

Nonetheless, even in the state in which the preliminary ink filling of the second pressure chamber 57 is complete, the timing for starting the intense suction must be set in such a manner as to optimize the corresponding operation. That is, the negative pressure caused in the choke suction step accumulates in an area downstream from the open-close valve 34. However, as compliance in this area becomes greater, the speed of the ink flow generated in the great negative pressure step becomes higher and thus the bubble discharge performance becomes higher. The "compliance" refers to a physical quantity representing volume change caused by a pressure difference. The compliance is relatively great for gas but relatively small for liquid.

If, for example, the choke suction step is initiated in the state of FIG. 5(*b*), a major portion of the area in which the negative pressure accumulates corresponds to a gas phase area, which exhibits relatively great compliance. In this case, a relatively large amount of ink must be moved in the great negative pressure step for compensating the accumulated negative pressure. The resulting ink flow thus becomes extremely rapid. Contrastingly, if the choke suction step is started in the state of FIG. 5(*d*) in which the entire supply passage is filled with the ink in such a manner that negative pressure accumulates, the negative pressure is rapidly compensated due to relatively small compliance in the area in which the negative pressure accumulates. It is thus impossible to cause a sufficiently rapid ink flow. That is, in the illustrated embodiment, the intense suction is performed effectively by carrying out the intense suction when the liquid edge is located at the preliminary position.

Figure 7:
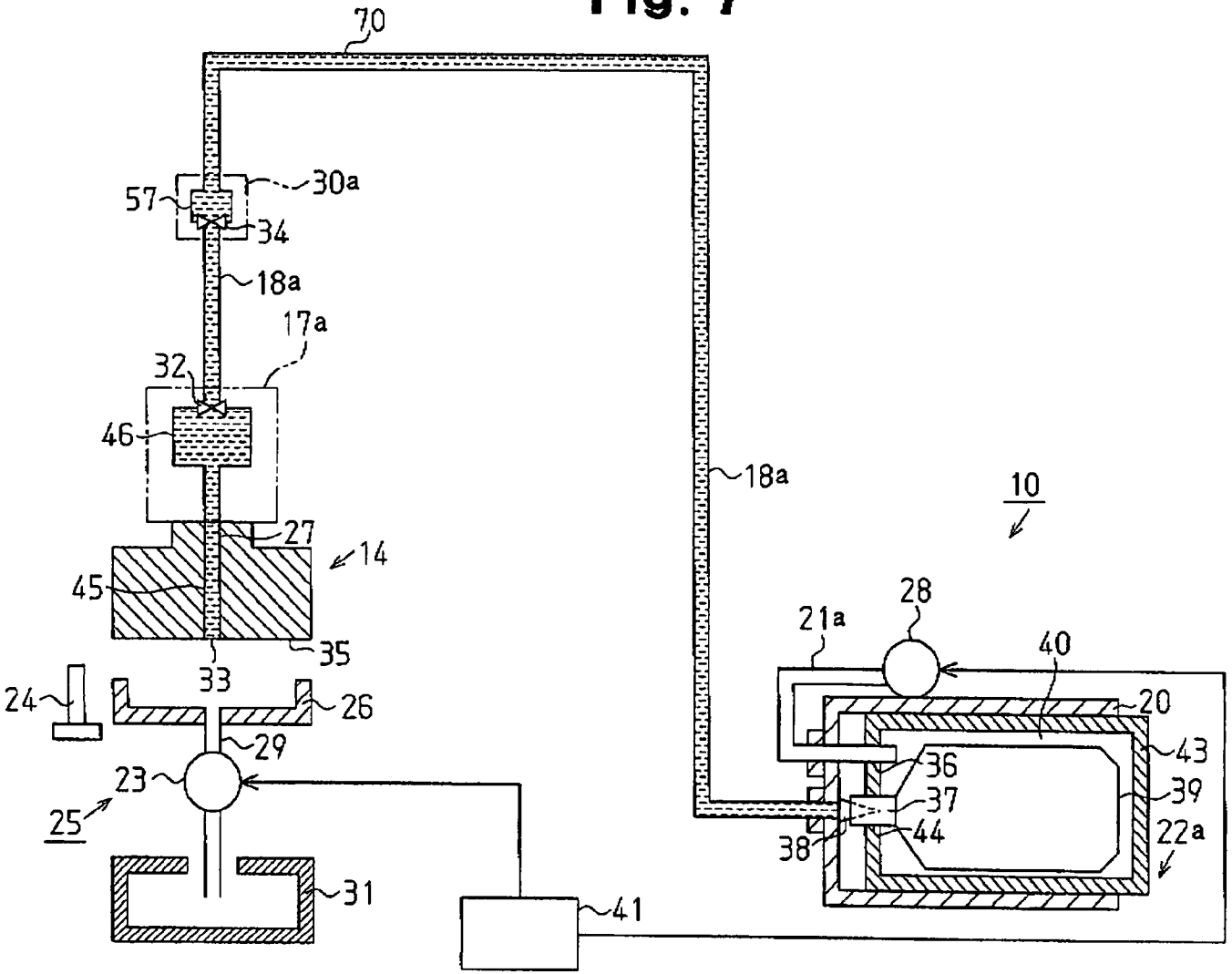
FIG. 7 is a diagrammatic view showing an ink supply system and a liquid discharge system of a printer of a modified example.

Further, as shown in FIG. 7, the supply tube 18*a* may be bent for forming a top portion 70 (a part of the supply tube 18*a*), which serves as a bubble trapping portion, at a position upstream from the second pressure chamber 57 in the supply tube 18*a*. The top portion 70 extends horizontally at a position higher than the second pressure chamber 57 and the bubbles are trapped in the top portion 70. In this case, the supply tube 18*a* includes an additional portion in which the bubbles are trapped, which is the top portion 70, other than the first and second pressure chambers 46, 57 (the enlarged portions).

Therefore, at an initial stage of the ink fill, the meniscus (the ink edge) is moved first to a position between the top portion 70 and the second pressure chamber 57 and then to a position between the second pressure chamber 57 and the first pressure chamber 46. Subsequently, the initial ink filling is continued in the same manner as the illustrated embodiment.

The present invention is not restricted to the illustrated embodiment. In terms of configuration of the supply passage, the present invention may be applied to the printer having the sub tank as an enlarged portion, as described in Japanese Laid-Open Patent Publication No. 2003-211689, or a printer having a pressure damper as an enlarged portion, as described in Japanese Laid-Open Patent Publication No. 2003-211688.

Alternatively, the number of the preliminary filling steps of the present invention may be changed as needed depending on the bubble discharge performance in the enlarged portions of the supply passage or the locations of these portions. For example, even if the supply passage includes two enlarged portions, a single preliminary filling step may be performed for preliminarily filling both of the enlarged portions with the ink.

In the preliminary or complete filling steps of the present invention, suction does not necessarily have to be performed. For example, in the printer of Japanese Laid-Open Publication No. 2003-211689, the ink filling can be achieved only by controlling the ink pressurization supply, without involving the suction.

The liquid filling method of the present invention is not restricted to application to the initial ink fill, which has been described. However, the liquid filling method may be employed for filling the supply passage with preservative liquid before product shipment or cleaning liquid for cleaning the supply passage.

Further, in the illustrated embodiment, a certain structure may be combined with a different structure or omitted as needed. Also, the structure may be combined with non-illustrated other structures.

The present examples and embodiments are to be considered as illustrative and not restrictive and the invention is not to be limited to the details given herein, but may be modified within the scope and equivalence of the appended claims.

The invention claimed is:

1. A liquid filling method for filling a continuous supply passage with a liquid supplied from a liquid container of a liquid ejection apparatus, the apparatus including the supply passage for supplying the liquid from the liquid container that retains the liquid to a nozzle for ejecting the liquid, wherein the supply passage includes tubular lines, a first enlarged portion and a second enlarged portion each communicating with the tubular lines, wherein each of the first and second enlarged portions has a width larger than a width of the tubular lines and traps bubbles when the supply passage is filled with the liquid, wherein the second enlarged portion is located closer to the nozzle than the first enlarged portion in the supply passage, wherein the method comprises:

a first preliminary filling step for moving a front edge of the liquid to a first preliminary position defined as a position between the first enlarged portion and the second enlarged portion in the supply passage, thereby to preliminarily fill the first enlarged portion with the liquid;

a second preliminary filling step for moving the front edge of the liquid to a second preliminary position defined as a position between the nozzle and the second enlarged portion, thereby to move the bubbles from the first enlarged portion toward the nozzle and preliminarily fill the second enlarged portion with the liquid; and a complete filling step for filling the supply passage entirely with the liquid subsequent to the second preliminary filling step, thereby to remove the bubbles trapped in the second enlarged portion through the nozzle.

2. The method according to claim 1, wherein the supply passage is filled not with the liquid but with a gas before the first preliminary filling step is performed.

3. The method according to claim 1, wherein:

the liquid ejection apparatus includes suction means for drawing a gas and the liquid from the supply passage through the nozzle; and the first preliminary, second preliminary, and complete filling steps each include:

a choke suction step in which suction is performed by the suction means with a portion of the supply passage held in a closed state; and a great negative pressure suction step in which the liquid is caused to flow by opening the closed portion of the supply passage.

4. The method according to claim 3, wherein the suction means includes a suction pump; and wherein the suction pump is continuously operated in a state transitional from the choke suction step to the great negative pressure suction step.

5. A liquid ejection apparatus comprising:

a liquid container for retaining a liquid;

a nozzle for ejecting the liquid;

a continuous supply passage for supplying the liquid from the liquid container to the nozzle; and a filling device for filling the supply passage with the liquid supplied from the liquid container;

wherein the supply passage includes tubular lines, a first enlarged portion, and a second enlarged portion each communicating with the tubular lines and each having a width larger than a width of the tubular lines, to trap bubbles when the supply passage is filled with the liquid, wherein the second enlarged portion is located closer to the nozzle than the first enlarged portion in the supply passage; and wherein the filling device firstly operates to move a front edge of the liquid to a first preliminary position defined as a position between the first enlarged portion and the second enlarged portion in the supply passage and secondly operates to move the front edge of the liquid to a secondary preliminary position defined as a position between the nozzle and the second enlarged portion, thereby to move the bubbles from the first enlarged portion toward the nozzle and preliminarily fill the second enlarged portion with the liquid and then fill the supply passage entirely with the liquid thereby to remove the bubbles trapped in the second enlarged portion through the nozzle.

6. The apparatus according to claim 5, further comprising:

a suction device for drawing a gas and the liquid from the supply passage through the nozzle; and an open-close valve capable of closing a portion of the supply passage in cooperation with the suction device.

7. The apparatus according to claim 6, wherein the first enlarged portion has a flexible film for changing the volume of the first enlarged portion.

8. The apparatus according to claim 5, wherein the second enlarged portion includes a pressure chamber and the liquid container has a casing and an ink pack accommodated in the casing.

* * * * *